US006178906B1

(12) United States Patent
Hoyt

(10) Patent No.: US 6,178,906 B1
(45) Date of Patent: Jan. 30, 2001

(54) SPAR FOR A SAILBOAT

(76) Inventor: John Garrison Hoyt, One Maritime Dr., Portsmouth, RI (US) 02871

( * ) Notice: Under 35 U.S.C. 154(b), the term of this patent shall be extended for 0 days.

(21) Appl. No.: 09/359,468

(22) Filed: Jul. 22, 1999

(51) Int. Cl.[7] ..... B63H 9/04

(52) U.S. Cl. ..... 114/102.28; 114/102.3; 114/104

(58) Field of Search ..... 114/89, 96, 97, 114/98, 102.1, 102.15, 102.24, 102.27, 102.28, 102.3, 104, 105

(56) References Cited

U.S. PATENT DOCUMENTS

| | | | | |
|---|---|---|---|---|
| 413,046 | * | 10/1889 | Gevalt | 114/98 |
| 757,474 | * | 4/1904 | Lowry | 114/102.3 |
| 3,464,379 | * | 9/1969 | Lawson | 114/102.28 |
| 3,861,343 | * | 1/1975 | Fretwell, Jr. | 114/104 |
| 4,101,289 | * | 7/1978 | Ebbeson et al. | 114/104 |
| 4,817,549 | | 4/1989 | Beatman | 114/102 |
| 5,347,945 | * | 9/1994 | McAlpine | 114/102.28 |

* cited by examiner

*Primary Examiner*—Stephen Avila
(74) *Attorney, Agent, or Firm*—Barlow, Josephs & Holmes, Ltd.

(57) ABSTRACT

A spar for controlling downwind headsails is pivoted to headsail instrumentalities for stowage in an aerodynamic sleeve with the headsail. The spar and the headsail has preconnected lines for controlling the spar and headsail all stored within the sleeve.

10 Claims, 4 Drawing Sheets

FIG. 1A.
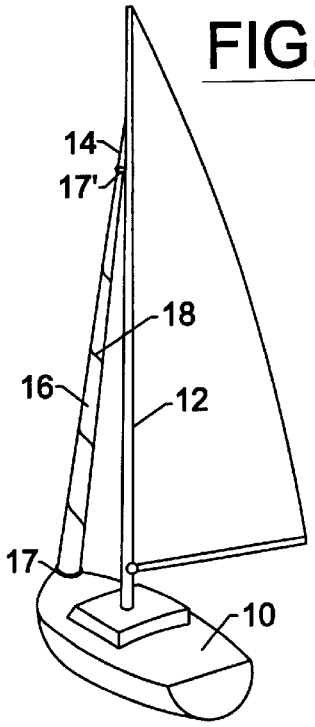
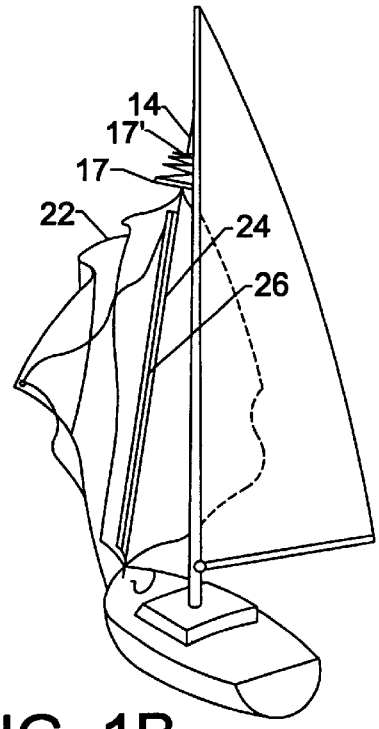
FIG. 1B.
FIG. 1C.
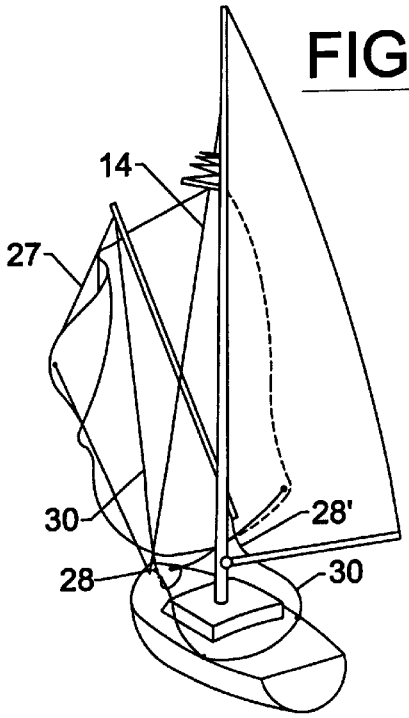
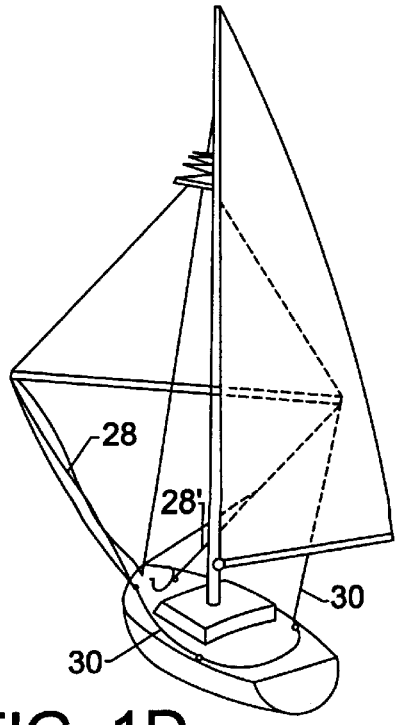
FIG. 1D.

SPAR FOR A SAILBOAT

BACKGROUND OF THE INVENTION

Sailboats that are fitted with a jib generally carry a whisker pole to keep the jib out when going down wind. Such a pole is fastened to the mast much like a spinnaker pole, but the whisker pole is of much lighter construction. The outboard end of the whisker pole is generally connected to a point adjacent the clew of the jib. This rig enables a sailboat when sailing from a beam reach to down wind to make the jib work rather than flap or collapsing from being blanketed by the mainsail. There is a need for a whisker pole or spar that can be easily handled by a cruising sailor with minimum effort. In a similar vein, the handling of spinnakers and particularly the smaller versions called cruising spinnakers is very difficult for the average sailor. There is therefore a need for a pole or spar that can be easily used that will enable the spinnaker to draw property in a balanced configuration. To enhance the performance of furled headsails, a sleeve that presents minimum wind resistance is desirable. This sleeve will also contain and protect the sail and spar.

SUMMARY OF THE INVENTION

It is a primary object of the present invention to provide a pole that is easily handled by the simple expedient of setting it with one line.

A further object of the invention is t o provide a pole that can be easily slowed within a furling jib or spinnaker.

A sailboat having the features of the present invention may comprise a mast and a jib fastened to the mast with a luff and clew, a single spar means has one end coupled to the luff of the jib while the other end has means coupling it adjacent the clew. A bungee cord fastened between the end of the pole and the head of the jib maintains the spar in a position parallel to the luff for stowage.

A further feature of the invention is the use of a cloth sleeve, which in its extended form will form a high aspect ratio foil. When the sleeve is allowed to rotate freely, the sleeve will present minimum wind resistance. Within the sleeve will be a folded sail and an attached spar that will be held substantially parallel to the headstay.

Therefore, the principal object of the invention is to provide a spar that is pivotally attached to the clew of a sail. In its folded or furled condition, the spar is held substantially vertical by the tension of a bungee cord that is connected to the head of the sail. To activate the spar to its vanging configuration, a downhaul line overpowers the bungee cord and pulls the spar firmly down into active position.

BRIEF DESCRIPTION OF THE DRAWINGS

FIGS. 1A, 1B, 1C and 1D are a sequence of perspective views of a sailboat illustrating the operation of a spinnaker stowed in an aerodynamic sleeve and the spar set in accordance with the invention;

DESCRIPTION OF THE PREFERRED EMBODIMENTS

Figure 7:
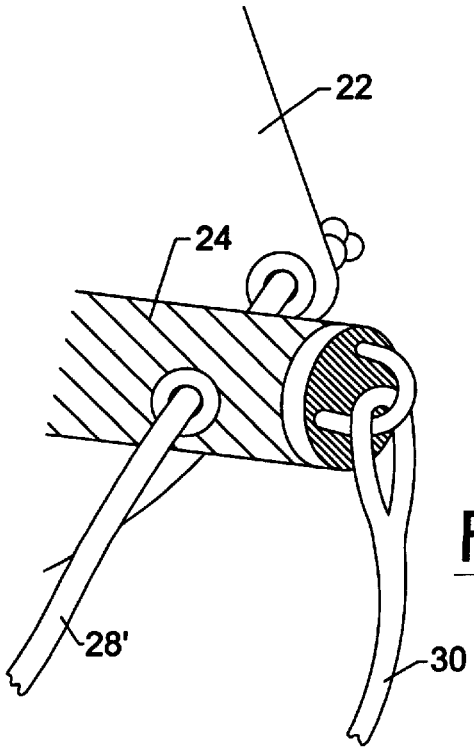
FIG. 7 is an enlarged view of the starboard clew of the sail in FIG. 1.

In FIG. 1 there is shown a sailboat 10 having a mast 12 and at least a headstay 14. Fastened to the upper portion of the headstay is an aerodynamic sleeve 16 with a rigid airfoil shaped hoop 17 at the base and a smaller airfoil hoop 17' aloft at the head of the sail. Essentially the sleeve is composed of sailcloth and has a plurality of battens 18 spaced throughout its length to maintain the airfoil shape. As seen best in FIG. 2A, there is provided lines 20 for raising and lowering the sleeve. Within the sleeve and fastened at its head to the mast by a halyard (not shown) is a spinnaker 22. A spar 24 is pivoted to the headstay as at 26 and may be maintained in an upright or substantially vertical position by a bungee cord fastened to one end thereof. A downhaul line 27 is affixed to either end of the spar, is passed through cringles at the clew of the spinnaker and thence through blocks 28, 28' or fed through an aperture in the pole as seen in FIG. 7. To control the trim of the spinnaker, there are lines 30 fastened to the pole ends and thence lead aft, often called sheet and guy.

The sequence of setting the spinnaker is simple. First hoist the sleeve to a retracted position aloft as seen in FIG. 1B and as this is proceeding the spinnaker begins to stream downwind. Preferably, the center of the foot is affixed so that the spinnaker will stream in two halves. The spar is then pulled to a horizontal position with the port downhaul line 27, which connects the spar through the clew of the spinnaker. The starboard downhaul line passes through an aperture in the pole as seen in FIG. 7. Lines 30 connected to the ends of the pole control the set of the spinnaker and trim the spar. Ideally, the spinnaker is "squared" to the wind.

To douse the spinnaker, the spar is returned to an upright position by pulling in on the starboard downhaul line. The main may blanket the spinnaker and the sleeve may be easily pulled down to "stuff" the spinnaker inside the foil shape.

Figure 2D:
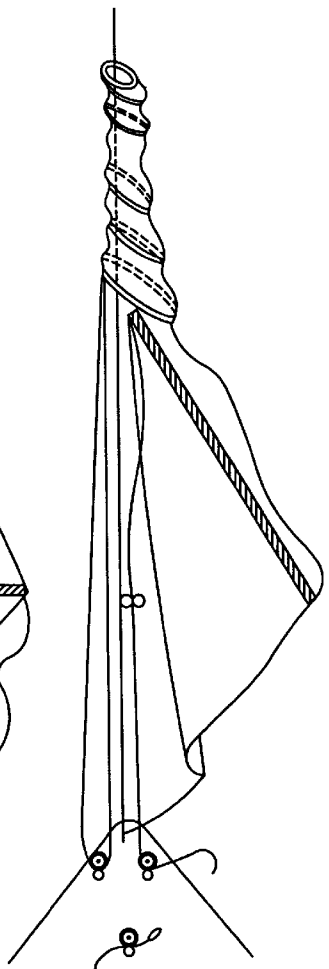
FIGS. 2A, 2B, 2C and 2D are a sequence of perspective views illustrating a jib within an aerodynamic sleeve and a sequence unfurling and setting the spar.
Figure 2C:
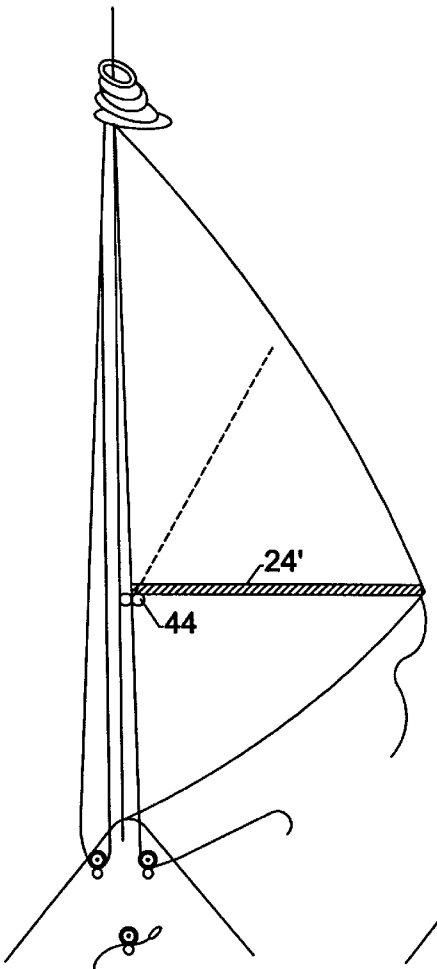
Figure 2B:
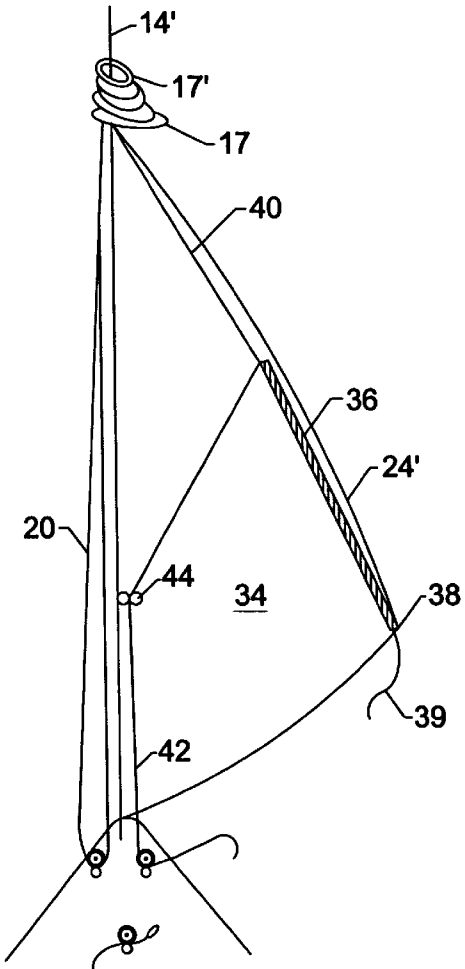
Figure 2A:
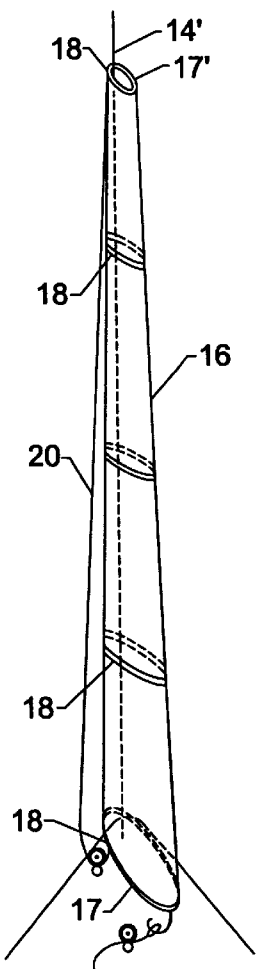

Referring now to FIGS. 2B, 2C and 2D a flying jib arrangement is illustrated. Jib 34 is affixed to the headstay 14' in the usual fashion as known to those skilled in the art and has a spar 36 pivoted to the clew 38. To maintain the spar in a storage position, a bungee cord 40 is attached. between the free end of the spar 24' and the head of the sail. As seen in FIG. 3C, the spar has been set by pulling on the downhaul line 42 that passes through a block 44 and the shock cord is now extended. Control of the jib is achieved in the normal fashion with a trim sheet 39. The jib can be doused by hauling down the sleeve 16. (See FIG. 2D).

Figure 3:
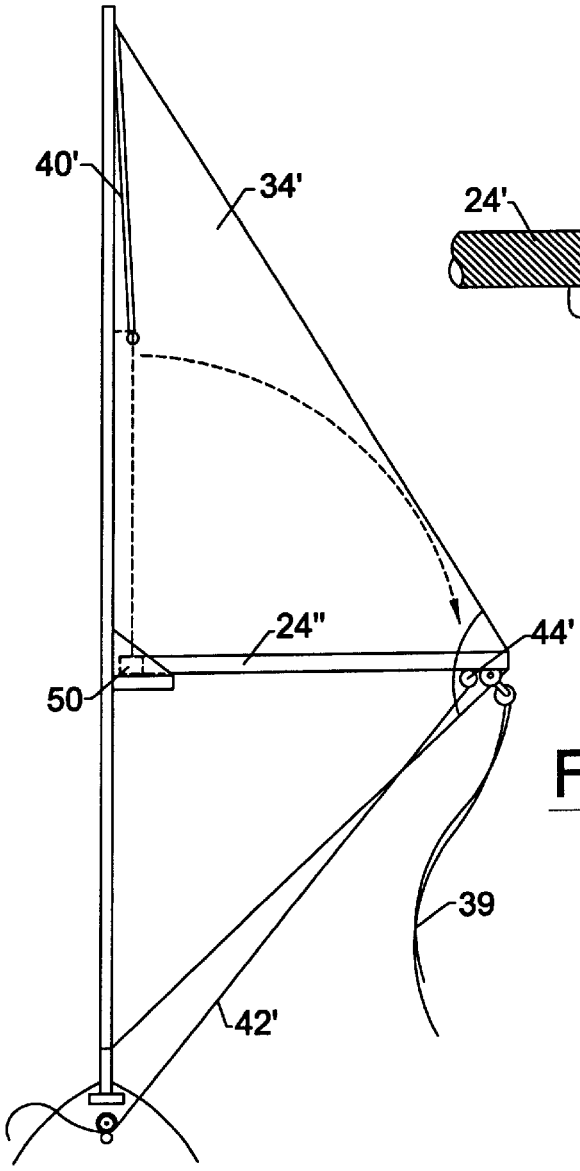
FIG. 3 shows an alternate version of the spar in which the spar 24" is pivoted adjacent the luff.

Referring now to FIG. 3, an alternate arrangement of the spar is illustrated. In this embodiment, the spar is pivoted as at 50 to the luff of the jib in a pocket fashioned on the sail. The spar is normally held parallel to the luff by bungee cord 40' and drawn down from the dotted line position by downhaul 42' that passes through a cheek block 44' fastened adjacent the clew of the jib. A sheet 39' for trimming the jib is fastened to the shackle pinned to the clew. This particular arrangement adapts itself to use with a conventional roller-furling jib.

The only other elements that will be wrapped are the downhaul line and its cheek block at the clew. This has the advantage that everything necessary excluding the sheet is wrapped in the furled jib.

Figure 4A:
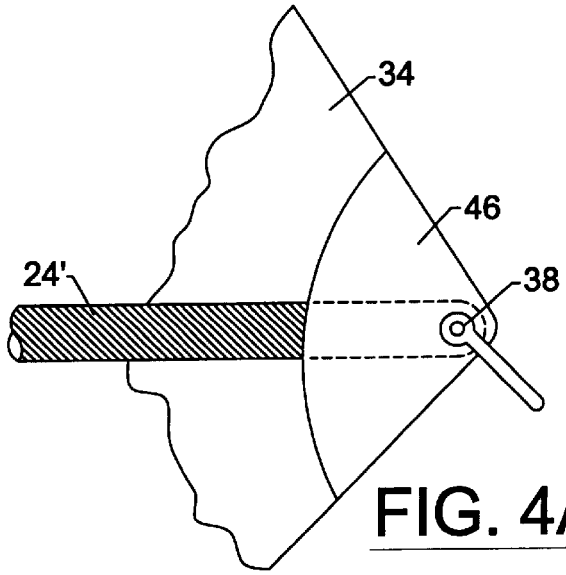
FIGS. 4A and 4B are enlarged views illustrating the details of the pivoting of the spar of FIG. 2.
Figure 4B:
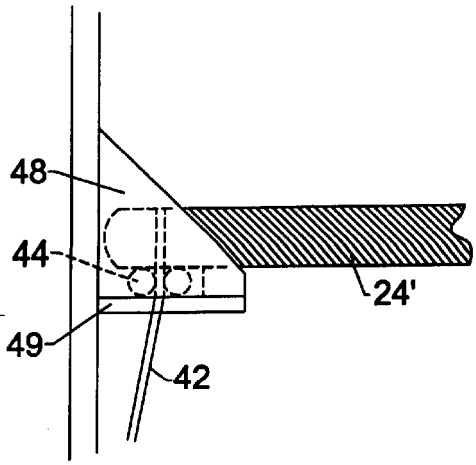

In FIG. 4A, I have shown the detail of one method for pivoting the spar to the clew of the jib as generally illustrated in FIGS. 2B–2D. A pocket 46 is formed at the clew 38. The spar has a pivot aperture adjacent its end and a shackle pin passes through the clew cringle and the aperture. FIG. 4B illustrated one method for fastening the block 44. A pocket 48 is formed with a shelf 49 at the luff of the sail onto which the block 44 is fastened. Other arrangements will suggest themselves to those skilled in the art.

Figure 5:
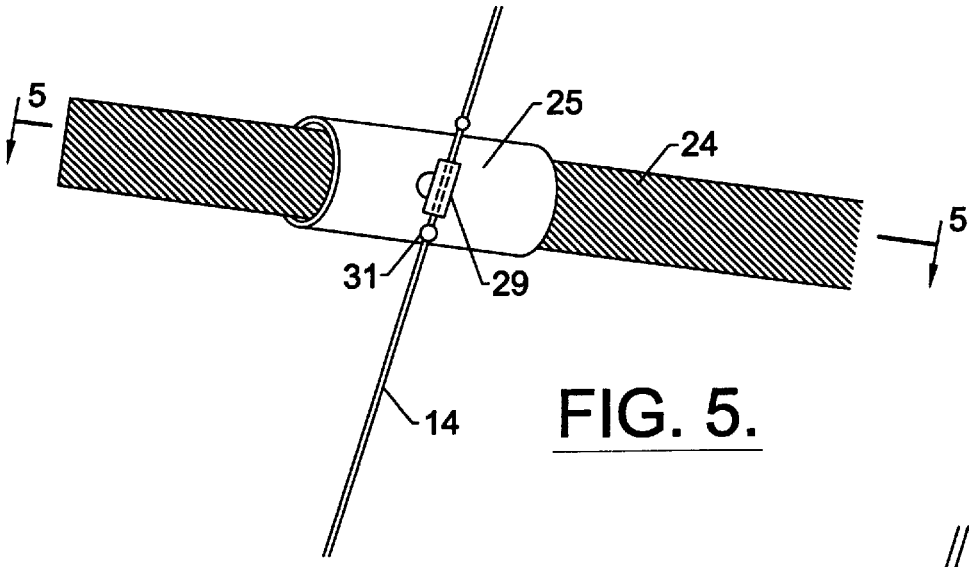
FIG. 5 is an enlarged view that illustrates the pivot joint on the spar used for a spinnaker set.
Figure 6:
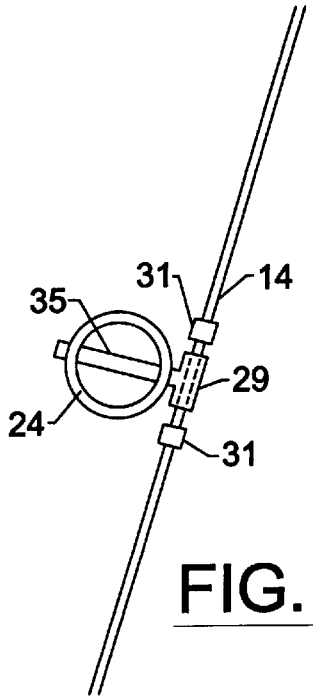
FIG. 6 is a sectional view taken on lines 5—5 of FIG. 5.

In FIGS. 5 and 6 I have illustrated a method of providing a pivot on the spar used in the spinnaker embodiment of FIGS. 1B–1D. A reinforcing tube 25 embraces the spar and through the sleeve and the spar a pin 35 extends which has one end welded to a sleeve 29. The sleeve 29 is maintained in position on the headstay by stops 31. The pin 35 may freely rotate in the aperture formed in the spar.

FIG. 7 shows the detail of the starboard end of the spar in the spinnaker embodiment and it is noted that the downhaul line 28' passes through an aperture in the spar, thence through a grommet and terminates in a stopper. The trimming sheet 30 is fastened to a ring or suitable means at the end of the pole.

The invention as set forth in the foregoing specification improves the speed, simplicity and safety of the setting jibing and retrieving an off wind sail that is normally an arduous and dangerous process requiring expert handling by experienced persons. In the spinnaker version, the invention there are many advantages amongst which it is noted that the spinnaker is already hoisted and the spar is attached. The balanced nature of the spar reduces trimming loads, which in a conventional arrangement is very high on the guy line. In the jib version the spar is already in place so there is no attaching to the mast as with a conventional whisker pole. The invention also allows the jib to be led forward on a reach, still maintaining the jib's effective shape which can not be accomplished with a whisker pole that is affixed to the mast.

The foregoing sets forth the invention in a practical form but the structure shown is capable of modification within a range of equivalents without departing from the invention.

What is claimed is:

1. A sailboat spar means comprising a lightweight, elongated pole having a pivot joint means, said pivot joint permitting the pole to rotate from a substantially vertical position to an operating position, said pivot joint being located at least at the pole end engaging at all times the clew of said sail means, said pole having means affixed thereto to normally maintain the pole in a vertical attitude.

2. The method of storing and setting a sail comprising the steps of:

a. providing a vessel with a mast, b. providing a sail with a head and clew, c. fastening the head of the sail to the mast, d. providing a spar and pivoting the spar to the sail, e. providing means to elastically support the spar in a general vertical attitude, f. providing a sleeve fastened above the head of the sail and having means for raising and lowering the sleeve, whereby when the sleeve is raised the sail unfurls and the spar is deployed to a generally horizontal position to support the clew of the sail.

3. A sailboat spar means comprising a lightweight, elongated pole having a pivot joint means, said pivot joint permitting the pole to rotate from a substantially vertical position to an operating position, said pole having an end engaging the clew of said sail means, said pole having means affixed thereto to normally maintain the pole in a vertical attitude, an aerodynamic sleeve having batten pockets fastened above the head of the sail having means to lower and raise the sleeve over the sail and curved battens in said pockets to maintain an aerodynamic shape when the sleeve is lowered.

4. A sail system comprising a sail having at least one clew, a mast, a headstay and a spar, an aerodynamic shaped sleeve enclosing the sail, spar and headstay, said elongated spar having at least a portion thereof supported by the headstay, said spar having a pivot means and means for raising the sleeve and deploying the spar from a vertical position to a horizontal position.

5. A method of setting a sail for downwind comprising the steps of:

a. providing a vessel with a mast and at least a headstay, b. providing a spar supported substantially parallel to the headstay, c. providing a sail having a head and with at least one clew, d. providing an aerodynamic sleeve for releasably enclosing the spar, headstay and the sail from the head to the foot, whereby when the sleeve is retracted, means are provided to deploy the spar to a substantially horizontal position and projecting the sail to its full span for downwind sailing and whereby when the sail is doused the spar will be returned to a generally vertical position and then the sleeve may be pulled downwardly to contain the sail and the spar.

6. A method as in claim 5 wherein the spar is pivotally attached to the headstay and means are provided for maintaining the spar in a position substantially parallel to the headstay.

7. A method as in claim 5 wherein the spar is pivotally attached to the clew of the sail and means are provided to maintain the spar in an upright position.

8. A sail system on a vessel in combination an aerodynamic sleeve embracing a headstay, the sleeve having a plurality of spaced pockets and curved battens in said pockets, a sail adapted for stowage within the sleeve, said sail having at least a clew, an elongated spar normally supported substantially vertical whereby when the sleeve is hoisted aloft, the spar is deployed in a horizontal mode and connected to at least one clew of the sail.

9. A sail system as in claim 8 wherein the spar is pivoted to a point adjacent the headstay.

10. A sail system as in claim 8 wherein the spar is pivoted to a point on the sail adjacent the clew.

* * * * *